US009790764B2

(12) United States Patent
Ezell

(10) Patent No.: US 9,790,764 B2
(45) Date of Patent: Oct. 17, 2017

(54) PACKER ASSEMBLY HAVING DUAL HYDROSTATIC PISTONS FOR REDUNDANT INTERVENTIONLESS SETTING

(75) Inventor: Michael Dale Ezell, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 277 days.

(21) Appl. No.: 14/412,153

(22) PCT Filed: Jul. 2, 2012

(86) PCT No.: PCT/US2012/045222

§ 371 (c)(1),
(2), (4) Date: Dec. 30, 2014

(87) PCT Pub. No.: WO2014/007794

PCT Pub. Date: Jan. 9, 2014

(65) Prior Publication Data

US 2015/0191991 A1 Jul. 9, 2015

(51) Int. Cl.
*E21B 33/128* (2006.01)
*E21B 33/129* (2006.01)
(Continued)

(52) U.S. Cl.
CPC ..... *E21B 33/1285* (2013.01); *E21B 23/06* (2013.01); *E21B 33/128* (2013.01); *E21B 33/1295* (2013.01)

(58) Field of Classification Search
CPC .. E21B 33/128; E21B 33/1285; E21B 33/129; E21B 33/1295; E21B 23/06
See application file for complete search history.

(56) References Cited

U.S. PATENT DOCUMENTS 3,460,616 A * 8/1969 Crow ..... E21B 33/1295 166/120
5,947,201 A 9/1999 Ross et al.
(Continued)

FOREIGN PATENT DOCUMENTS

CN 102425392 A 4/2012
WO WO 2010/027936 A1 3/2010

OTHER PUBLICATIONS

European Extended Search Report fur Patent Application No. 12850575.1 dated Apr. 25, 2016, 7 pages.
(Continued)

*Primary Examiner* — Cathleen Hutchins
(74) *Attorney, Agent, or Firm* — Haynes and Boone, LLP

(57) ABSTRACT

A packer for use in a wellbore includes a packer mandrel. First and second pistons are slidably disposed about the packer mandrel defining first and second chambers therewith. A first activation assembly initially prevents movement of the first piston. A second activation assembly initially prevents movement of the second piston. A seal assembly is disposed about the packer mandrel between the first and second pistons such that actuation of the first activation assembly allows a force generated by a pressure difference between the wellbore and the first chamber to shift the first piston in a first direction toward the seal assembly to radially expand the seal assembly and actuation of the second activation assembly allows a force generated by a pressure difference between the wellbore and the second chamber to shift the second piston in a second direction toward the seal assembly to radially expand the seal assembly.

25 Claims, 11 Drawing Sheets

(51) Int. Cl.
*E21B 33/1295* (2006.01)
*E21B 23/06* (2006.01)

(56) References Cited

U.S. PATENT DOCUMENTS

| | | | | |
|---|---|---|---|---|
| 2007/0144731 | A1 | 6/2007 | Murray et al. | |
| 2007/0246227 | A1* | 10/2007 | Ezell | E21B 23/06 166/387 |
| 2009/0229832 | A1 | 9/2009 | King | |
| 2010/0012330 | A1 | 1/2010 | Ezell et al. | |

OTHER PUBLICATIONS

International Search Report and the Written Opinion of the International Searching Authority, or the Declaration, Feb. 28, 2013, PCT/US2012/045222, 14 pages, International Searching Authority, KR.

* cited by examiner

PACKER ASSEMBLY HAVING DUAL HYDROSTATIC PISTONS FOR REDUNDANT INTERVENTIONLESS SETTING

The present application is a U.S. National Stage patent application of International Patent Application No. PCT/US2012/045222, filed on Jul. 2, 2012, the benefit of which is claimed and the disclosure of which is incorporated herein by reference in its entirety.

TECHNICAL FIELD OF THE INVENTION

This invention relates, in general, to equipment utilized in conjunction with operations performed in subterranean wells and, in particular, to a packer assembly having dual hydrostatic pistons for redundant interventionless setting.

BACKGROUND OF THE INVENTION

Without limiting the scope of the present invention, its background will be described in relation to setting packers, as an example.

In the course of preparing a subterranean well for hydrocarbon production, one or more packers are commonly installed in the well. The purpose of the packers is to support production tubing and other completion equipment and to provides a seal in the well annulus between the outside of the production tubing and the inside of the well casing to isolate fluid and pressure thereacross.

Certain production packers are set hydraulically by establishing a differential pressure across a setting piston. Typically, this is accomplished by running a tubing plug on wireline, slick line, electric line, coiled tubing or another conveyance into the production tubing to a profile location. Fluid pressure within the production tubing may then be increased, thereby creating a pressure differential between the fluid within the production tubing and the fluid in the wellbore annulus. This pressure differential actuates the setting piston to expand the seal assembly of the production packer into sealing engagement with the casing. Thereafter, the tubing plug is retrieved to the surface such that production operations may begin.

As operators increasingly pursue production in deeper water offshore wells, highly deviated wells and extended reach wells, for example, the rig time required to set the tubing plug and thereafter retrieve the tubing plug can negatively impact the economics of the project, as well as add unnecessary complications and risks. To address these issues associated with hydraulically set packers, interventionless packer setting techniques have been developed. For example, a hydrostatically actuated setting module has been incorporated into the bottom end of a packer to exert an upward setting force on the packer piston. The hydrostatic setting module may be actuated by applying pressure to the production tubing and the wellbore at the surface, with the setting force being generated by a combination of the applied surface pressure and the hydrostatic pressure associated with the fluid column in the wellbore.

In operation, once the packer is positioned at the required setting depth, surface pressure is applied to the production tubing and the wellbore annulus until a port isolation device actuates, thereby allowing wellbore fluid to enter an initiation chamber on one side of the piston while the chamber engaging the other side of the piston remains at an evacuated pressure. This creates a differential pressure across the piston that causes the piston to move, beginning the setting process. Once the setting process begins, O-rings in the initiation chamber move off seat to open a larger flow area such that fluid entering the initiation chamber continues actuating the piston to complete the setting process. Therefore, the bottom-up hydrostatic setting module provides an interventionless method for setting packers as the setting force is provided by available hydrostatic pressure and applied surface pressure without plugs or other well intervention devices.

It has been found, however, that the bottom-up hydrostatic setting module may not be ideal for applications where the wellbore annulus and production tubing cannot be pressured up simultaneously. Such applications include, for example, when a packer is used to provide liner top isolation or when a packer is landed inside an adjacent packer in a stacked packer completion. In such circumstances, if a bottom-up hydrostatic setting module is used to set a packer above another sealing device, there is only a limited annular region between the unset packer and the previously set sealing device below. Therefore, when the operator pressures up on the wellbore annulus, the hydrostatic pressure begins actuating the bottom-up hydrostatic setting module to exert an upward setting force on the piston. When the packer sealing elements start to engage the casing, however, the limited annular region between the packer and the lower sealing device becomes closed off and can no longer communicate with the upper annular area that is being pressurized from the surface. Thus, the trapped pressure in the limited annular region between the packer and the lower sealing device is soon dissipated and may not fully set the packer.

Accordingly, a need has arisen for improved packer for providing a seal between a tubular string and a wellbore surface. In addition, a need has arisen for such an improved packer that does not require a plug to be tripped into and out of the well to enable setting. Further, a need has arisen for such an improved packer that is operable to be set without the application of both tubing pressure and annulus pressure.

SUMMARY OF THE INVENTION

The present invention disclosed herein comprises a packer assembly having dual hydrostatic pistons for redundant interventionless setting that is operable to provide a seal between a tubular string and a wellbore surface. The packer assembly of the present invention does not require a plug to be tripped into and out of the well to enable setting. In addition, the packer assembly of the present invention is operable to be set without the application of both tubing pressure and annulus pressure.

In one aspect, the present invention is directed to a packer assembly for use in a wellbore. The packer assembly includes a packer mandrel. A first piston is slidably disposed about the packer mandrel defining a first chamber therewith. A first activation assembly is disposed about the packer mandrel initially preventing movement of the first piston. A second piston is slidably disposed about the packer mandrel defining a second chamber therewith. A second activation assembly is disposed about the packer mandrel initially preventing movement of the second piston. A seal assembly is disposed about the packer mandrel and positioned between the first and second pistons such that actuation of the first activation assembly allows a force generated by a pressure difference between the wellbore and the first chamber to shift the first piston in a first direction toward the seal assembly to radially expand the seal assembly and actuation of the second activation assembly allows a force generated by a pressure difference between the wellbore and the second chamber to shift the second piston in a second direction toward the seal assembly to radially expand the seal assembly.

In one embodiment, the packer assembly may include a slip assembly disposed about the packer mandrel and positioned between the first and second pistons. The slip assembly may have first and second slip elements such that the first slip element is positioned between the seal assembly and the first piston and the second slip element is positioned between the seal assembly and the second piston. In some embodiments, the first activation assembly may include a first housing section that defines a first activation chamber with the packer mandrel and the first piston. In these embodiments, a first pressure actuated element may be positioned in a first fluid flow path between the wellbore and the first activation chamber to initially prevent fluid flow therethrough until wellbore pressure exceeds a first predetermined actuation pressure. Also, in these embodiments, a first frangible member may initially couple the first piston to the first housing section.

In certain embodiments, the second activation assembly may includes a second housing section that defines a second activation chamber with the packer mandrel and the second piston. In these embodiments, a second pressure actuated element may be positioned in a second fluid flow path between the wellbore and the second activation chamber to initially prevent fluid flow therethrough until wellbore pressure exceeds a second predetermined actuation pressure. Also, in these embodiments, a second frangible member may initially couple the second piston to the second housing section. In one embodiment, the first and second predetermined actuation pressures may be substantially the same. In another embodiment, the first and second predetermined actuation pressures are different. In some embodiments, the first piston may define a contingency chamber with the packer mandrel such that increasing pressure in the contingency chamber shifts the first piston in the first direction toward the seal assembly to radially expand the seal assembly.

In another aspect, the present invention is directed to a method for setting a packer assembly in a wellbore. The method includes providing a packer assembly having a packer mandrel with a seal assembly disposed thereabout; running the packer assembly into the wellbore; preventing movement of a first piston toward the seal assembly with a first activation assembly disposed about the packer mandrel; preventing movement of a second piston toward the seal assembly with a second activation assembly disposed about the packer mandrel; actuating the first activation assembly to allow a force generated by a pressure difference between the wellbore and a first chamber defined between the first piston and the packer mandrel to shift the first piston in a first direction toward the seal assembly to radially expand the seal assembly; and actuating the second activation assembly to allow a force generated by a pressure difference between the wellbore and a second chamber defined between the second piston and the packer mandrel to shift the second piston in a second direction toward the seal assembly to radially expand the seal assembly.

The method may also include radially expanding a slip assembly disposed about the packer mandrel, breaking a first frangible member coupling the first piston to a first housing section, bursting a first pressure actuated element responsive to an increase in wellbore pressure to a first predetermined actuation pressure, pressurizing a first activation chamber disposed between a first housing section, the packer mandrel and the first piston, exposing a first piston area of the first piston to wellbore pressure, breaking a second frangible member coupling the second piston to a second housing section, bursting a second pressure actuated element responsive to an increase in wellbore pressure to a second predetermined actuation pressure, pressurizing a second activation chamber disposed between a second housing section, the packer mandrel and the second piston and/or exposing a second piston area of the second piston to wellbore pressure.

In a further aspect, the present invention is directed to a method for setting a packer assembly in a wellbore. The method includes providing a packer assembly having a packer mandrel with a seal assembly disposed thereabout; running the packer assembly into the wellbore; preventing movement of a first piston toward the seal assembly with a first activation assembly disposed about the packer mandrel; preventing movement of a second piston toward the seal assembly with a second activation assembly disposed about the packer mandrel; increasing wellbore pressure to a first predetermined actuation pressure; actuating the first activation assembly to allow a force generated by a pressure difference between the wellbore and a first chamber defined between the first piston and the packer mandrel to shift the first piston in a first direction toward the seal assembly to radially expand the seal assembly; increasing wellbore pressure to a second predetermined actuation pressure; and actuating the second activation assembly to allow a force generated by a pressure difference between the wellbore and a second chamber defined between the second piston and the packer mandrel to shift the second piston in a second direction toward the seal assembly to radially expand the seal assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the present invention.

Figure 1:
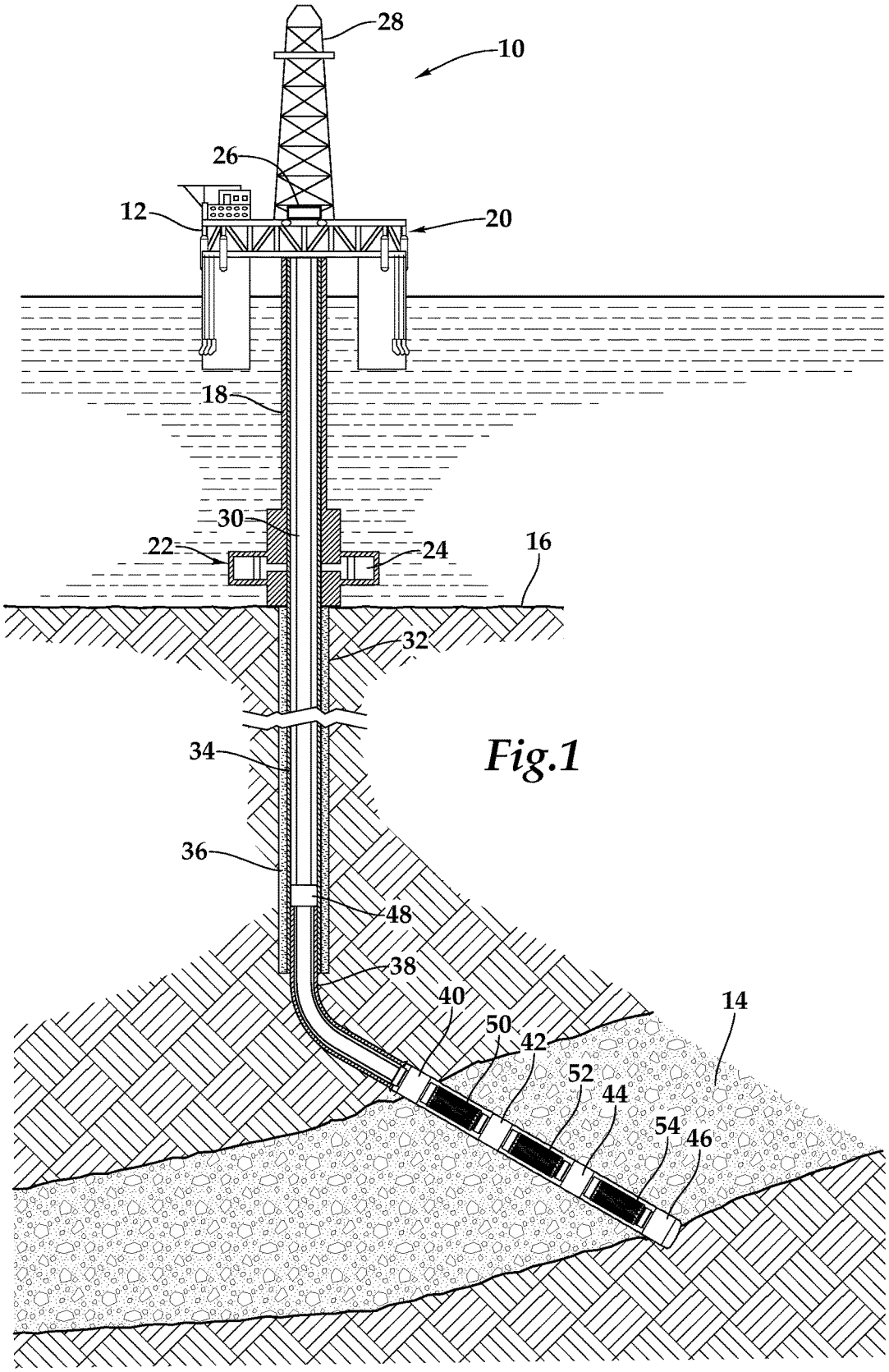
FIG. 1 is a schematic illustration of an offshore platform operating a plurality of packer assemblies having dual hydrostatic pistons for redundant interventionless setting in accordance with an embodiment of the present invention.
Figure 2A:
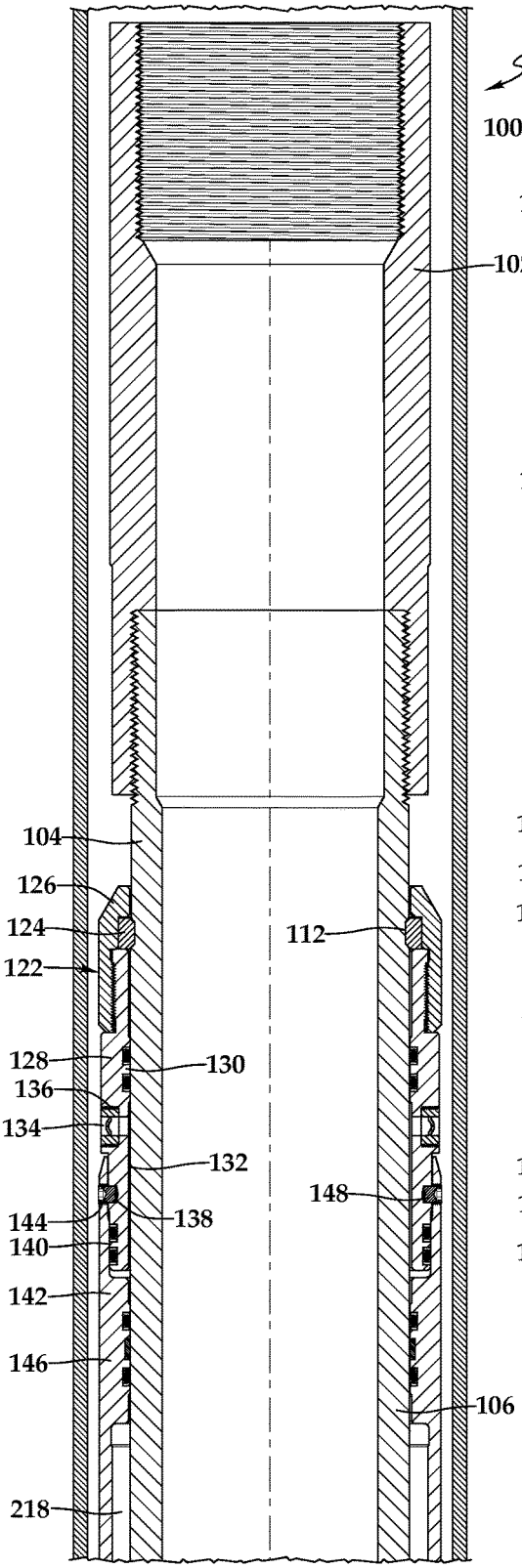
FIGS. 2A-2D are cross-sectional views of consecutive axial sections of a packer assembly having dual hydrostatic pistons for redundant interventionless setting in accordance with an embodiment of the present invention in its running configuration.
Figure 2B:
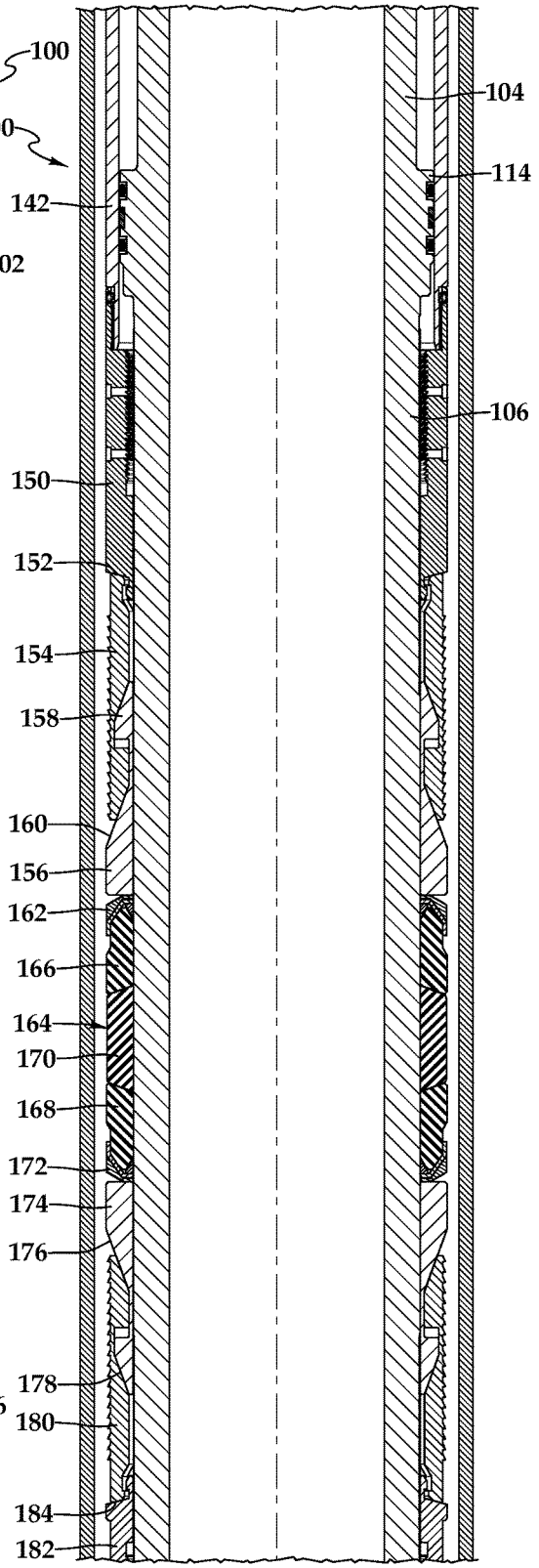
Figure 2C:
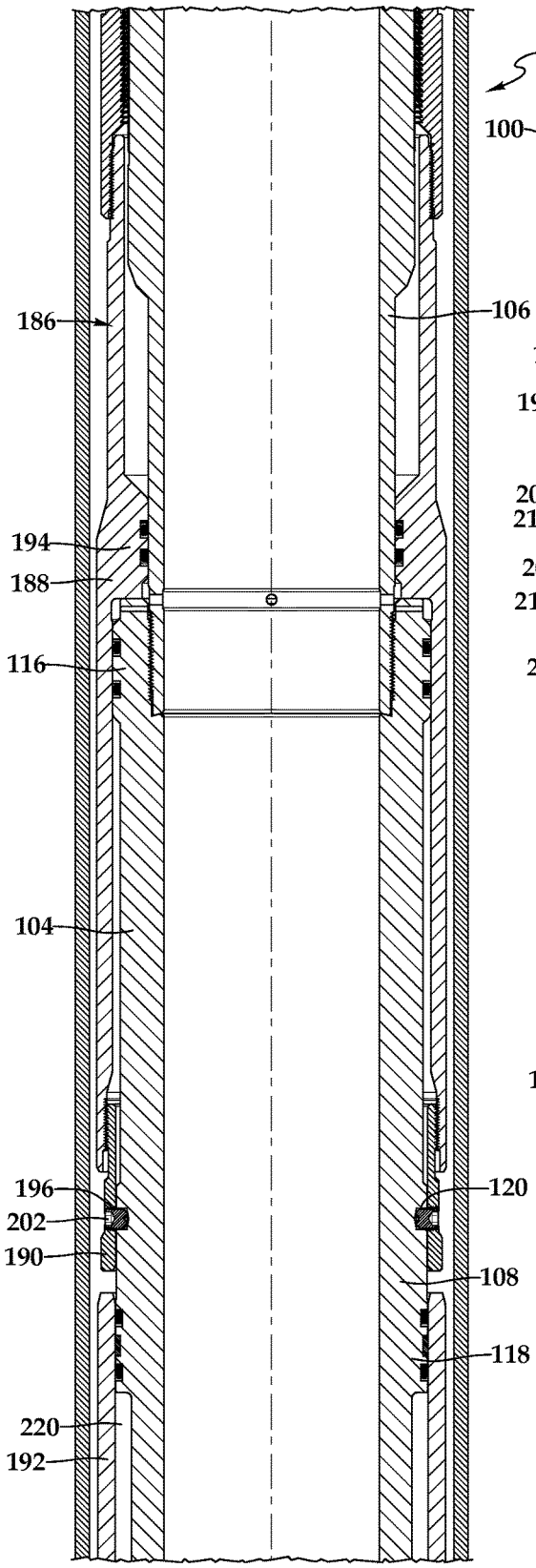
Figure 2D:
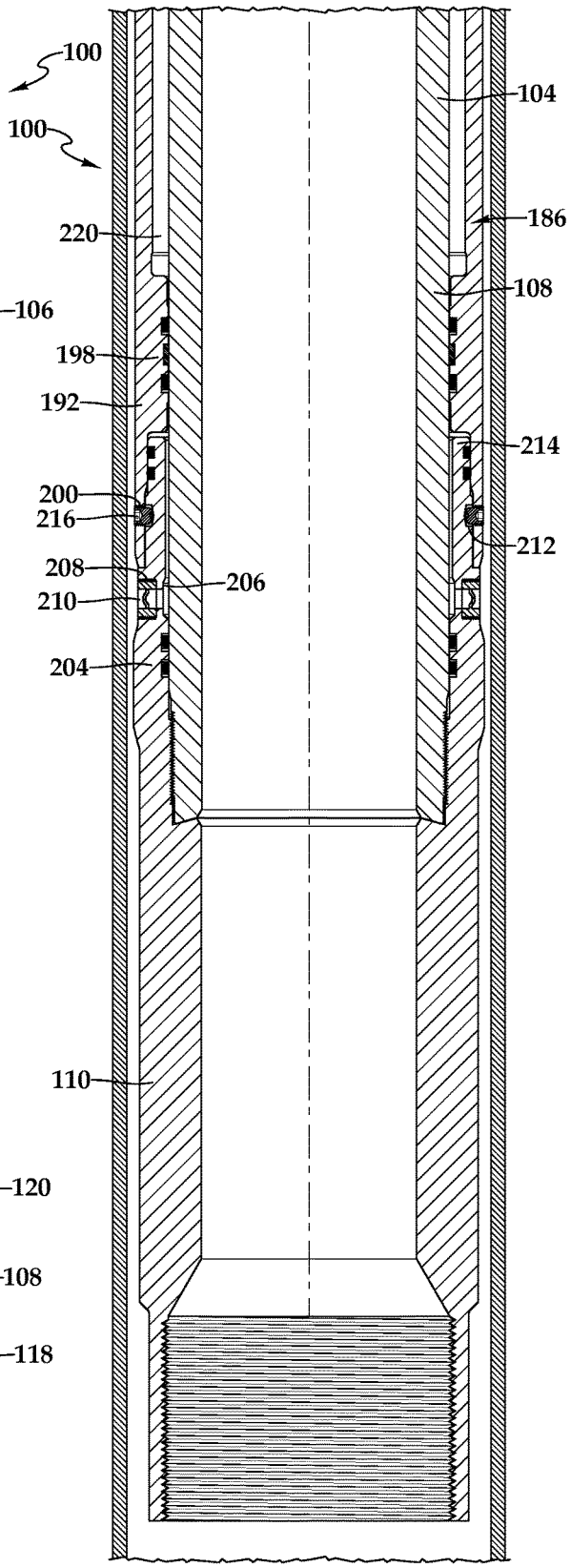
Figure 3A:
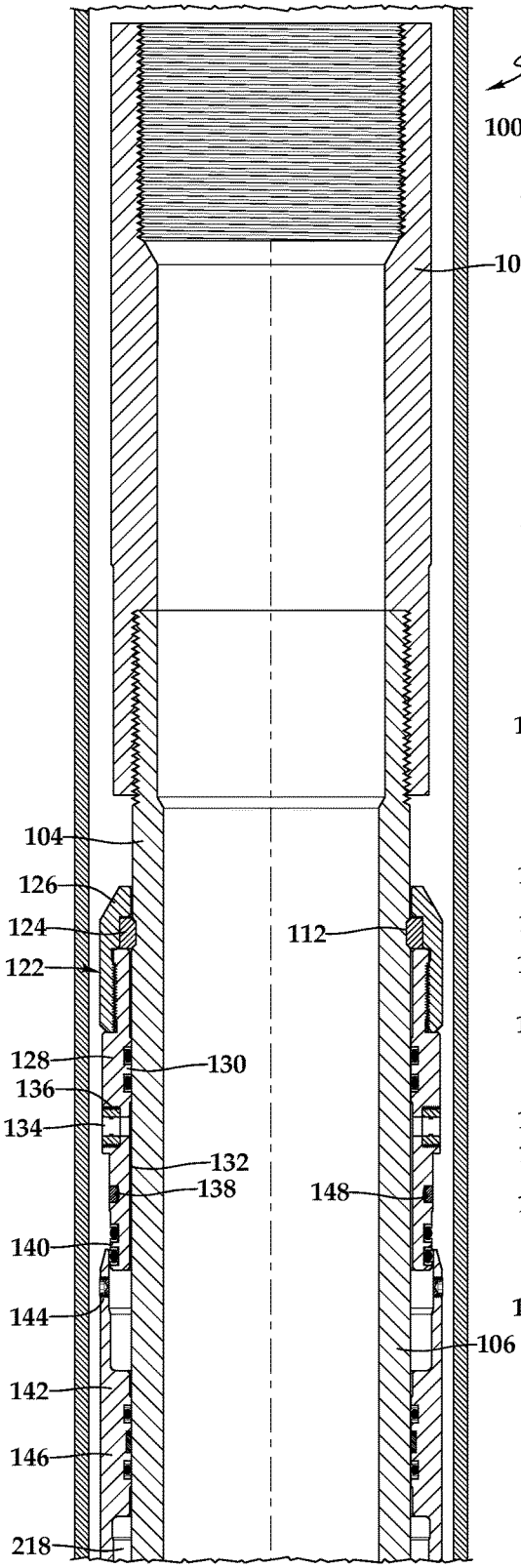
FIGS. 3A-3D are cross-sectional views of consecutive axial sections of a packer assembly having dual hydrostatic pistons for redundant interventionless setting in accordance with an embodiment of the present invention in a set configuration.
Figure 3B:
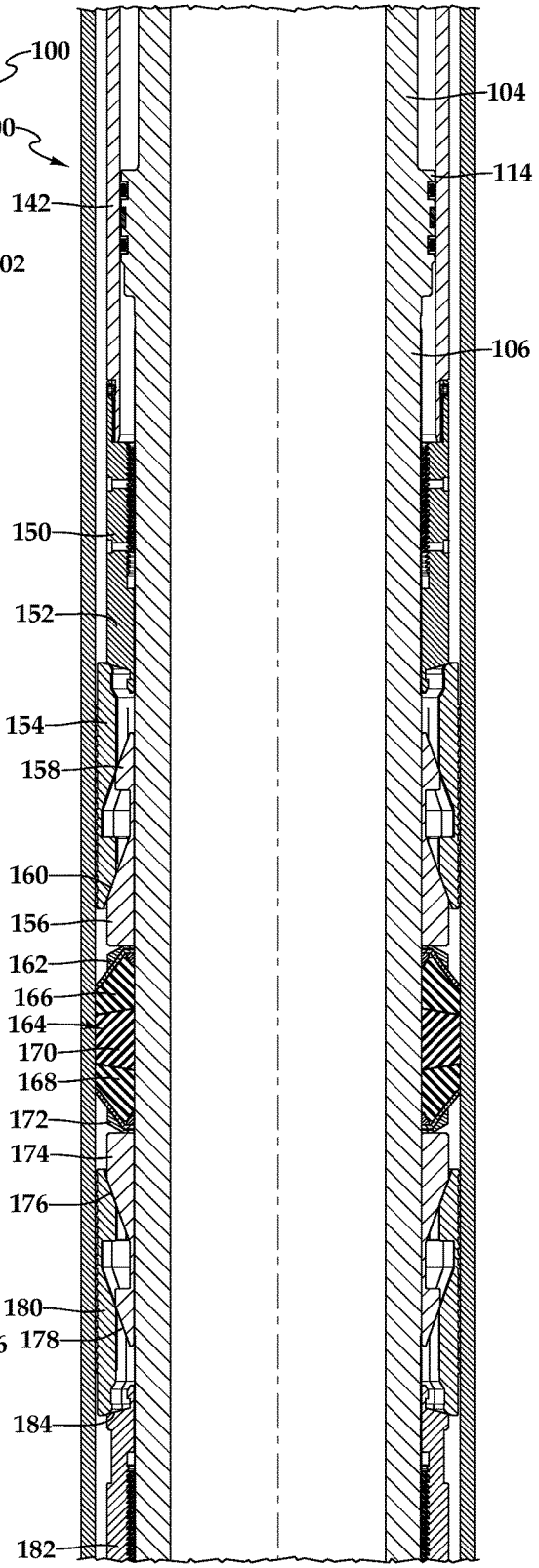
Figure 3C:
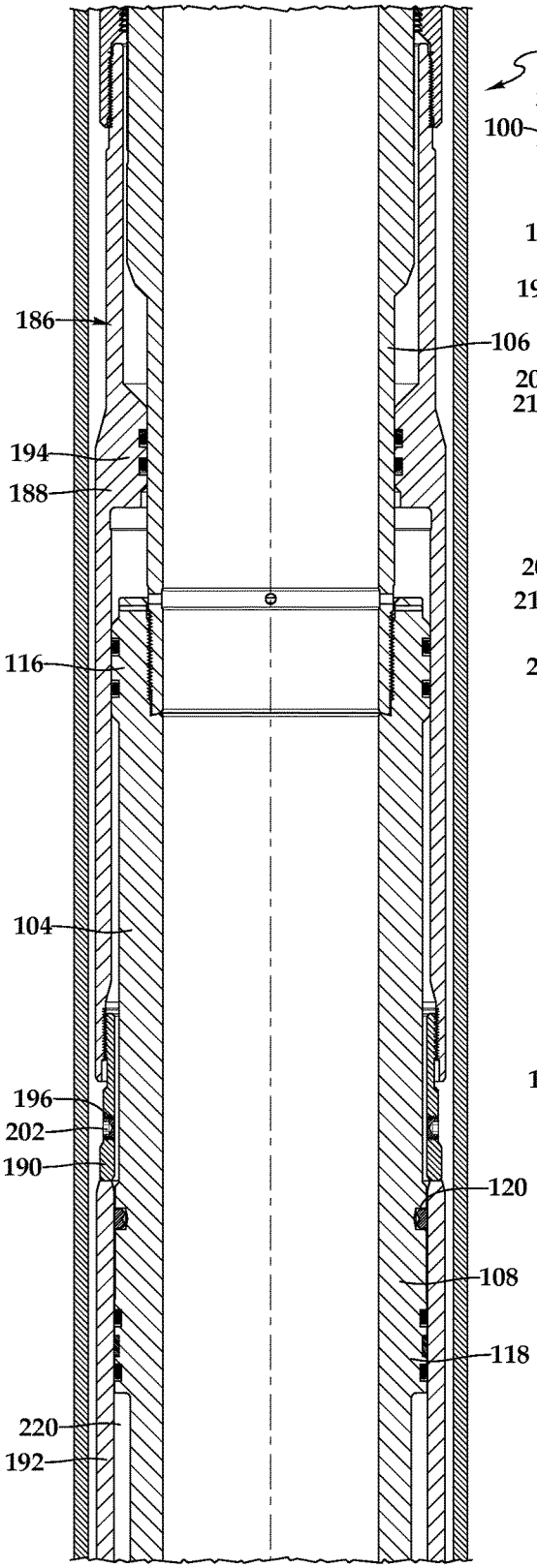
Figure 3D:
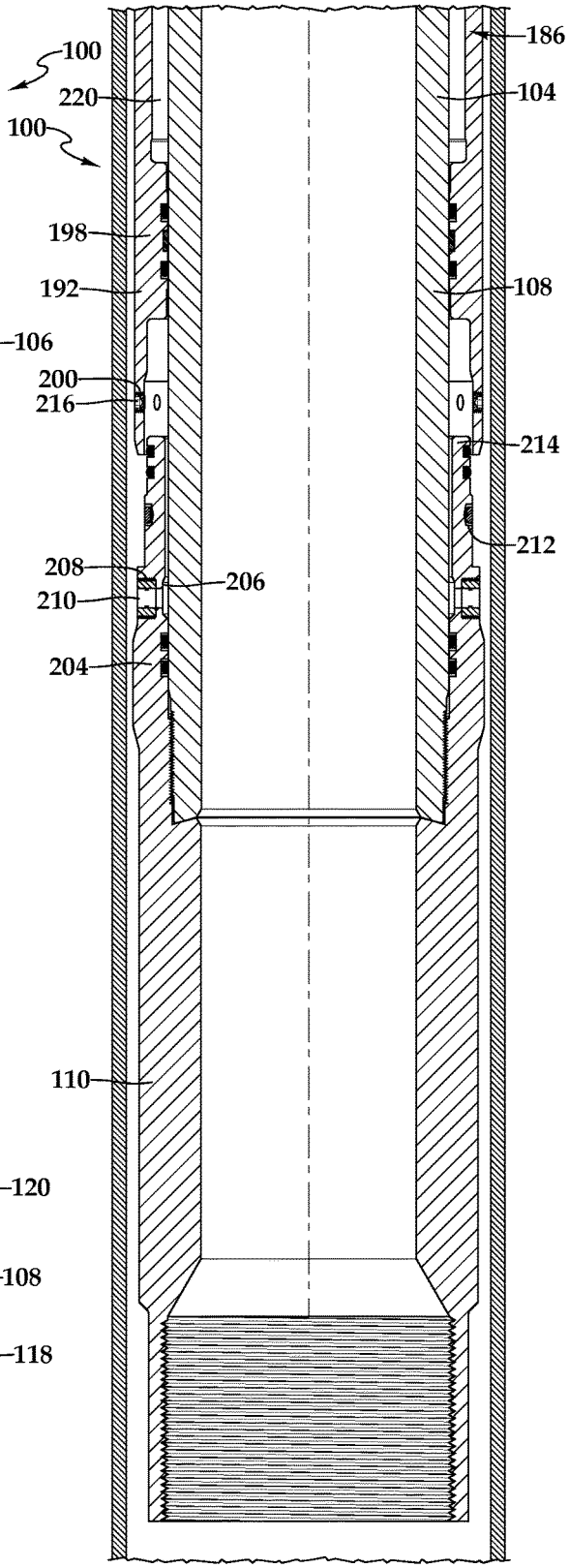

Referring initially to FIG. 1, a plurality of packer assemblies having dual hydrostatic pistons for redundant interventionless setting are being installed in an offshore oil or gas well that is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings, such as work string 30.

A wellbore 32 extends through the various earth strata including formation 14. A casing 34 is secured within a vertical section of wellbore 32 by cement 36. An upper end of a liner 38 is secured to the lower end of casing 34 by a suitable liner hanger. Note that, in this specification, the terms "liner" and "casing" are used interchangeably to describe tubular materials, which are used to form protective linings in wellbores. Liners and casings may be made from any material such as metals, plastics, composites, or the like, may be expanded or unexpanded as part of an installation procedure. Additionally, it is not necessary for a liner or casing to be cemented in a wellbore.

Work string 30 may include one or more packer assemblies 40, 42, 44, 46, 48 of the present invention that may be located proximal to the top of liner 38 or as part of the completion to provide zonal isolation. Packer assemblies 40, 42, 44, 46, 48 include dual hydrostatic pistons for redundant interventionless setting. When set, packer assemblies 40, 42, 44, 46 isolate zones of the annulus between wellbore 32 and completion string, while packer assembly 48 provides a seal between tubular string 30 and casing 34. In addition, the completion includes sand control screen assemblies 50, 52, 54 that are located substantially proximal to formation 14. As shown, packer assemblies 40, 42, 44, 46 may be located above and below each set of sand control screen assemblies 50, 52, 54. In this manner, formation fluids from formation 14 may enter sand control screen assemblies 50, 52, 54 between packer assemblies 40, 42, between packer assemblies 42, 44 and between packer assemblies 44, 46, respectively.

Even though FIG. 1 depicts the packer assemblies of the present invention in a slanted wellbore, it should be understood by those skilled in the art that the present invention is equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be understood by those skilled in the art that the packer assemblies of the present invention are equally well-suited for use in onshore operations.

Referring now to FIGS. 2A-2D, therein are depicted successive axial sections of a packer assembly having dual hydrostatic pistons for redundant interventionless setting that is representatively illustrated and generally designated 100. Packer assembly 100 includes an upper adaptor 102 that may be threadably coupled to another downhole tool or tubular as part of a tubular string as described above. At its lower end, upper adaptor 102 is threadably coupled to an upper end of packer mandrel 104. In the illustrated embodiment, packer mandrel 104 includes an upper packer mandrel section 106 that is threadably coupled to a lower mandrel section 108. Packer assembly 100 includes a lower adaptor 110 that is threadably coupled to a lower end of packer mandrel 104 and that may be threadably coupled to another downhole tool or tubular at its lower end to form part of a tubular string as described above.

Packer mandrel 104 includes a receiving profile 112 near its upper end. Packer mandrel 104 also includes a sealing profile 114, a sealing profile 116 and a sealing profile 118, each of which include multiple sealing elements such as O-rings or other packing elements. In addition, packer mandrel 104 includes a pin groove 120. Positioned around an upper portion of packer mandrel 104 is an upper housing section 122. Upper housing section 122 includes a connection ring 124, an upper connector 126 and an upper activation assembly 128 that is threadably coupled to upper connector 126. Upper activation assembly 128 includes a sealing profile 130 having multiple sealing elements to provide sealing engagement with packer mandrel 104. Upper activation assembly 128 and packer mandrel 104 form an upper activation chamber 132 therebetween. Upper activation assembly 128 includes one or more radial fluid passageways 134 that are depicted as having pressure actuated elements such as rupture disks 136 disposed therein in FIG. 2A. Upper activation assembly 128 also includes a pin groove 138 and a sealing profile 140 having multiple sealing elements.

Slidably disposed about packer mandrel 104 is an upper piston 142 that includes a plurality of threaded openings 144 and has a sealing profile 146 having multiple sealing elements. Upper piston 142 is initially coupled to upper activation assembly 128 by a plurality of frangible members depicted a shear screws 148. In this configuration shown in FIG. 2A, activation chamber 132 is defined between upper piston 142, upper activation assembly 128 and packer mandrel 104. At its lower end, upper piston 142 is threadably coupled to a wedge 150 that is disposed about packer mandrel 104. Wedge 150 has a camming outer surface 152 that is operable to engage an inner surface of an upper slip element 154 that is disposed about packer mandrel 104 and includes teeth located along its outer surface for providing a gripping arrangement with the interior of the well casing when set. Upper slip element 154 is located between wedge 150 and a wedge 156 that includes a pair of ramps 158, 160. As explained in greater detail below, when a compressive force is generated between wedge 150, upper slip element 154 and wedge 156, upper slip element 154 is radially expanded into contact with the well casing.

Substantially adjacent to wedge 156 is an upper element backup shoe 162 that is slidably positioned around packer mandrel 104. Additionally, a seal assembly 164, depicted as expandable seal elements 166, 168, 170, is slidably positioned around packer mandrel 104 between upper element backup shoe 162 and a lower element backup shoe 172. In the illustrated embodiment, even though three expandable seal elements 166, 168, 170 are depicted and described, those skilled in the art will recognizes that a seal assembly of the packer of the present invention may include any number of seal elements.

Upper element backup shoe 162 and lower element backup shoe 172 may be made from a deformable or malleable material, such as mild steel, soft steel, brass and the like and may be thin cut at their distal ends. The ends of upper element backup shoe 162 and lower element backup shoe 172 will deform and flare outwardly toward the inner surface of the casing or formation during the setting sequence as further described below. In one embodiment, upper element backup shoe 162 and lower element backup shoe 172 form a metal-to-metal barrier between packer assembly 100 and the inner surface of the casing.

Another wedge 174 including a pair of ramps 176, 178 is disposed about packer mandrel 104. Below wedge 174 is a lower slip element 180 that is disposed about packer mandrel 104 and includes teeth located along its outer surface for providing a gripping arrangement with the interior of the well casing when set. Lower slip element 180 is located between wedge 174 and a wedge 182 that has a camming outer surface 184 that is operable to engage an inner surface of lower slip element 180. As explained in greater detail below, when a compressive force is generated between wedge 174, lower slip element 180 and wedge 182, lower slip element 180 is radially expanded into contact with the well casing. Together, upper and lower slip elements 154, 180 may be referred to herein as a slip assembly.

A lower piston assembly 186 is slidably disposed about packer mandrel 104 and coupled to wedge 182 through a threaded connection. In the illustrated embodiment, lower piston assembly 186 includes a lower piston extension 188, a lower intermediate piston section 190 that is threadably coupled to lower piston extension 188 and lower piston 192. Even though lower piston assembly 186 is depicted and describes as having three sections including sections that are not physically coupled together, those skilled in the art will recognize that other arrangements of piston sections including a greater number or lesser number of piston sections including a single piston section could alternatively be used in the present invention. Lower piston assembly 186 includes a sealing profile 194 having multiple sealing elements, a plurality of threaded openings 196, a sealing profile 198 having multiple sealing elements and a plurality of threaded openings 200. Lower intermediate piston section 190 is initially coupled to packer mandrel 104 by a plurality of frangible members depicted a shear screws 202.

In the illustrated embodiment, lower adaptor 110 may be referred to as a lower housing section 110 or a lower activation assembly 110. Even though lower adaptor 110 is depicted and described as a single tubular section, those skilled in the art will recognize that a lower activation assembly need not be integral with the lower adaptor. Lower activation assembly 110 includes a sealing profile 204 having multiple sealing elements to provide sealing engagement with packer mandrel 104. Lower activation assembly 110 and packer mandrel 104 form a lower activation chamber 206 therebetween. Lower activation assembly 110 includes one or more radial fluid passageways 208 that are depicted as having pressure actuated elements such as rupture disks 210 disposed therein in FIG. 2D. Lower activation assembly 110 also includes a pin groove 212 and a sealing profile 214 having multiple sealing elements. Lower piston 192 is initially coupled to lower activation assembly 110 by a plurality of frangible members depicted as shear screws 216. In this configuration shown in FIG. 2D, lower activation chamber 206 is defined between lower piston 192, lower activation assembly 110 and packer mandrel 104.

An atmospheric chamber 218 is disposed between upper piston 142 and packer mandrel 104 and more particularly between sealing profile 146 of upper piston 142 and sealing profile 114 of packer mandrel 104. Preferably, atmospheric chamber 218 is initially evacuated by pulling a vacuum. Similarly, an atmospheric chamber 220 is disposed between lower piston 192 and packer mandrel 104 and more particularly between sealing profile 198 of lower piston 192 and sealing profile 118 of packer mandrel 104. Preferably, atmospheric chamber 220 is initially evacuated by pulling a vacuum.

Referring collectively to FIGS. 2A-2D and 3A-3D an operating mode of packer assembly 100 will now be described. Packer assembly 100 is shown before and after activation and expansion of expandable seal elements 166, 168, 170 and slip elements 154, 180, respectively, in FIGS. 2A-2D and 3A-3D. Packer assembly 100 may be run into a wellbore on a work string or similar tubular string to a desired depth and then set against a casing string, a liner string or other wellbore surface including an open hole surface. It is noted that during run in, upper activation assembly 128 prevents downward shifting of upper piston 142 by preventing fluid pressure from entering upper activation chamber 132 due to the presence of rupture disks 136 in fluid passageways 134. In addition, upper piston 142 is initially coupled to upper activation assembly 128 by shear screws 148. Further, due to the exposed upper and lower piston areas of upper piston 142, wellbore pressure tends to bias upper piston 142 in a direction away from seal assembly 164. Likewise, lower activation assembly 110 prevents upward shifting of lower piston 192 by preventing fluid pressure from entering lower activation chamber 206 due to the presence of rupture disks 210 in fluid passageways 208. In addition, lower piston 192 is initially coupled to lower assembly 110 by shear screws 216. Further, due to the exposed upper and lower piston areas of lower piston 192, wellbore pressure tends to bias lower piston 192 in a direction away from seal assembly 164.

Setting a accomplished by increasing the wellbore or annulus pressure surrounding packer assembly 100 to an actuation pressure sufficient burst rupture disks 136, 210. For example, when rupture disks 210 burst, fluid pressure from the wellbore enters activation chamber 206 via fluid passageway 208. The force generated by the fluid pressure acting on a lower surface of lower piston 192 breaks the shear screws 216 allowing lower piston 192 to move upwardly against any opposing force generated by pressure within atmospheric chamber 220, which is preferably negligible. Lower piston 192 then contacts lower intermediate piston section 190 breaking shear screws 202. Lower piston assembly 186 now moves as a single unit in the upward direction toward seal assembly 164. In this configuration, the entire lower surface of lower piston 192 is now exposed to wellbore pressure which generates an upward force on lower piston 192 and drives lower piston assembly 186 in the upward direction. At the same time, when rupture disks 136 burst, fluid pressure from the wellbore enters upper activation chamber 132 via fluid passageway 134. The forced generated by the fluid pressure acting on an upper surface of upper piston 142 breaks the shear screws 148 allowing upper piston 142 to move downwardly against any opposing force generated by pressure within upper atmospheric chamber 218, which is preferably negligible. As upper piston 142 shifts downwardly, the entire upper surface of upper piston 142 becomes exposed to wellbore pressure which generates a downward force on upper piston 192 and drives upper piston 142 in the downward direction.

The upwardly moving lower piston assembly 186 acts upon wedge 182 to move wedge 182 upward towards slip element 180. As wedge 182 contacts slip element 180, slip element 180 moves upwardly over wedge 174, which starts to set slip element 180 against the setting surface. As slip element 180 is extending outwardly, it also moves upward causing an upward force on wedge 174 allowing wedge 174 to apply an upward force on lower element backup shoe 172, which begins to move upward relative to packer mandrel 104. At the same time, the downwardly moving upper piston 142 act upon wedge 150 to move wedge 150 downward towards slip element 154. As wedge 150 contacts slip element 154, slip element 154 moves upwardly over wedge 156, which starts to set slip element 154 against the setting surface. As slip element 154 is extending outwardly, it also moves downward causing a downward force on wedge 156 allowing wedge 156 to apply a downward force on upper element backup shoe 162, which begins to move downward relative to packer mandrel 104.

The simultaneous upward movement of lower element backup shoe 172 and downward movement of upper element backup shoe 162 applies a compressive force against seal assembly 164 which causes radial expansion of seal elements 166, 168, 170. In addition, the compressive forces cause upper element backup shoe 162 and lower element backup shoe 172 to flare outward toward the sealing surface to provide a metal-to-metal seal against a casing or liner string. In this manner, the dual hydrostatic pistons of packer assembly 100 create a sealing relationship between seal elements 166, 168, 170 and the setting surface as well as a gripping relationship between slip elements 154, 180 and the setting surface. In addition, once packer assembly 100 is set, wellbore pressure above packer assembly 100 tends to further secure slip element 154 and compress seal elements 166, 168, 170 due to the downward force applied on upper piston 142. Likewise, wellbore pressure below packer assembly 100 tends to further secure slip element 180 and compress seal elements 166, 168, 170 due to the upward force applied on lower piston 192.

Referring collectively to FIGS. 2A-2D and 4A-4D, an second operating mode of packer assembly 100 will now be described. Packer assembly 100 is shown before and after activation and expansion of expandable seal elements 166, 168, 170 and slip elements 154, 180, respectively, in FIGS. 2A-2D and 4A-4D. Packer assembly 100 may be run into a wellbore on a work string or similar tubular string to a desired depth and then set against a casing string, a liner string or other wellbore surface including an open hole surface. It is noted that during run in, upper activation assembly 128 prevents downward shifting of upper piston 142 by preventing fluid pressure from entering upper activation chamber 132 due to the presence of rupture disks 136 in fluid passageways 134. In addition, upper piston 142 is initially coupled to upper activation assembly 128 by shear screws 148. Further, due to the exposed upper and lower piston areas of upper piston 142, wellbore pressure tends to bias upper piston 142 in a direction away from seal assembly 164. Likewise, lower activation assembly 110 prevents upward shifting of lower piston 192 by preventing fluid pressure from entering lower activation chamber 206 due to the presence of rupture disks 210 in fluid passageways 208. In addition, lower piston 192 is initially coupled to lower assembly 110 by shear screws 216. Further, due to the exposed upper and lower piston areas of lower piston 192, wellbore pressure tends to bias lower piston 192 in a direction away from seal assembly 164.

Setting a accomplished by increasing the wellbore or annulus pressure surrounding packer assembly 100 to an actuation pressure sufficient burst rupture disks 136. When rupture disks 136 burst, fluid pressure from the wellbore enters upper activation chamber 132 via fluid passageway 134. The forced generated by the fluid pressure acting on an upper surface of upper piston 142 breaks the shear screws 148 allowing upper piston 142 to move downwardly against any opposing force generated by pressure within upper atmospheric chamber 218, which is preferably negligible. As upper piston 142 shifts downwardly, the entire upper surface of upper piston 142 becomes exposed to wellbore pressure which generates a downward force on upper piston 192 and drives upper piston 142 in the downward direction.

Figure 4A:
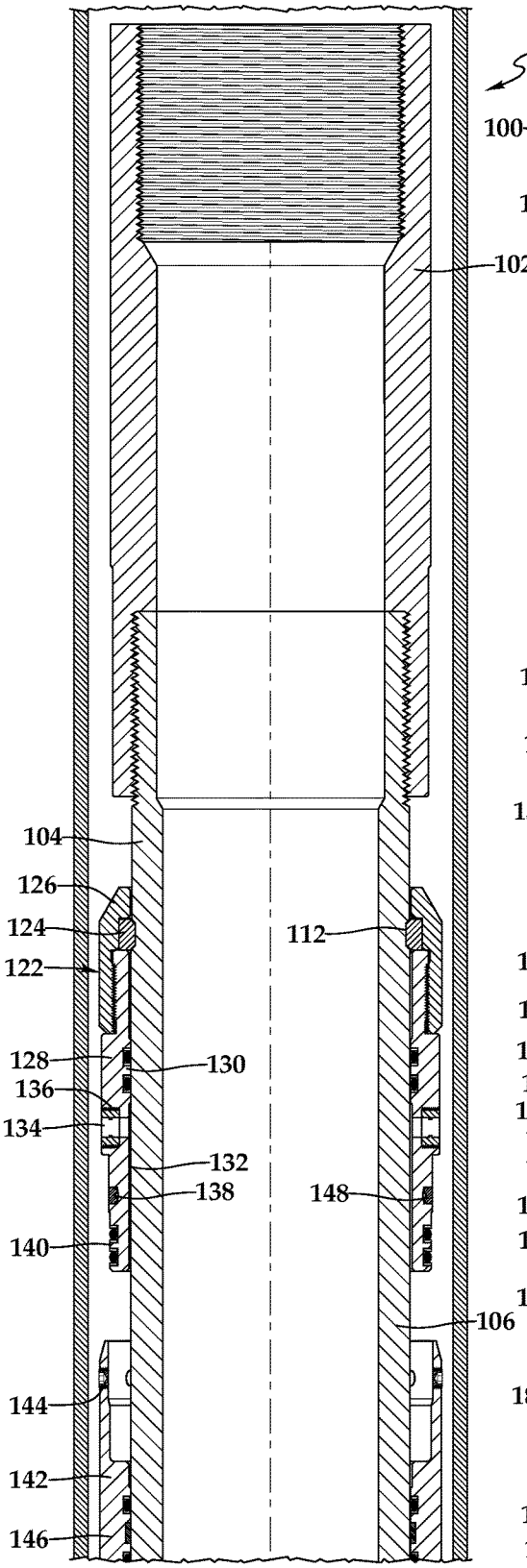
FIGS. 4A-4D are cross-sectional views of consecutive axial sections of a packer assembly having dual hydrostatic pistons for redundant interventionless setting in accordance with an embodiment of the present invention in a set configuration.
Figure 4B:
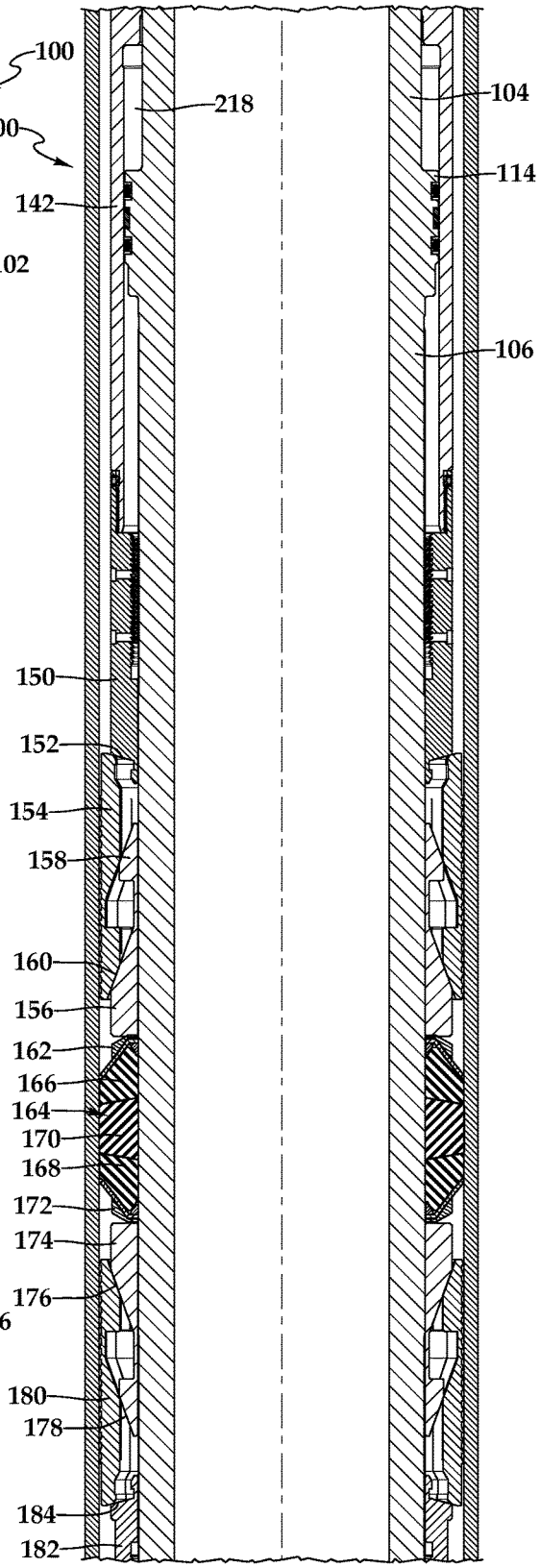
Figure 4C:
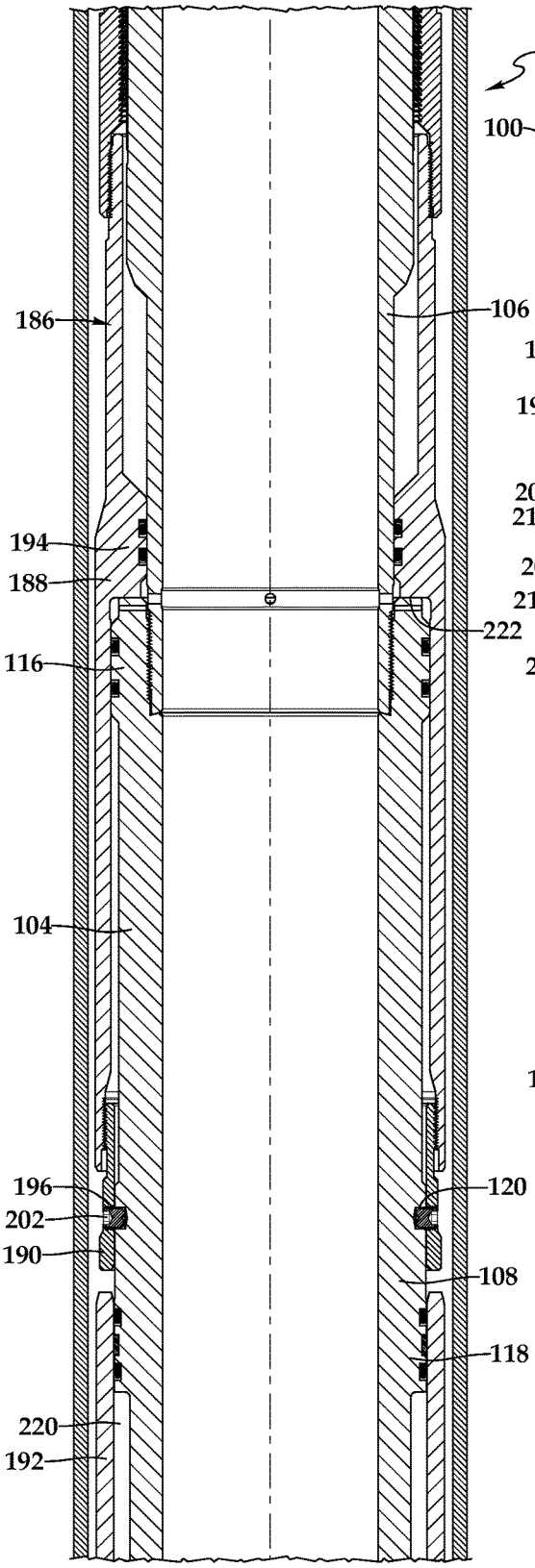
Figure 4D:
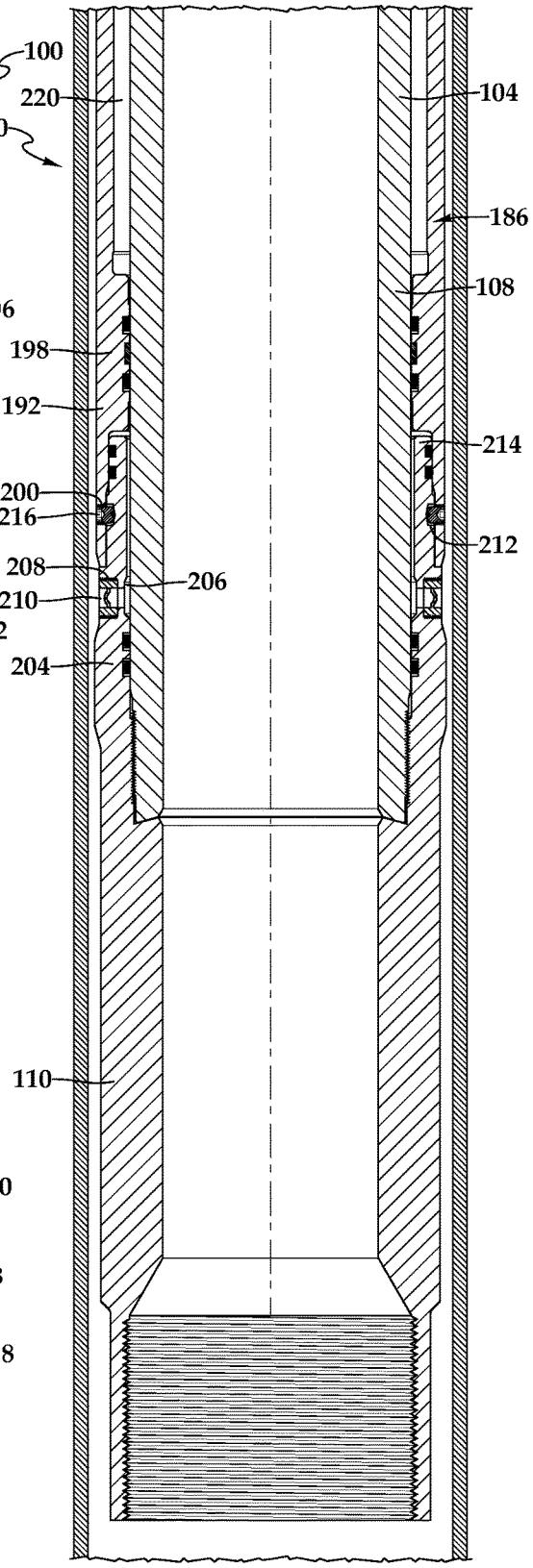

The downwardly moving upper piston 142 act upon wedge 150 to move wedge 150 downward towards slip element 154. As wedge 150 contacts slip element 154, slip element 154 moves upwardly over wedge 156, which starts to set slip element 154 against the setting surface. As slip element 154 is extending outwardly, it also moves downward causing a downward force on wedge 156 allowing wedge 156 to apply a downward force on upper element backup shoe 162, which begins to move downward relative to packer mandrel 104. The downward movement of upper element backup shoe 162 shifts seal assembly 164 downwardly causing lower element backup shoe 172 to act downwardly on wedge 174. Wedge 174 moves down against and under slip element 180, which starts to set slip element 180 against the setting surface. As slip element 180 is extending outwardly, it also moves downward causing a downward force on wedge 182. Downward movement of wedge 182 is disallowed by lower piston assembly 186 as a lower surface of lower piston extension 188 contacts an upper surface of packer mandrel 104 at location 222, as best seen in FIG. 4C.

The compressive force between upper piston 142 and lower piston extension 188 causes radial expansion of seal elements 166, 168, 170 and causes upper element backup shoe 162 and lower element backup shoe 172 to flare outward toward the sealing surface to provide a metal-to-metal seal against a casing or liner string. In this manner, operation of only the upper piston of the dual hydrostatic pistons of packer assembly 100 creates a sealing relationship between seal elements 166, 168, 170 and the setting surface as well as a gripping relationship between slip elements 154, 180 and the setting surface such that packer assembly 100 is fully set. In this configuration, wellbore pressure above packer assembly 100 tends to further secure slip element 154 and compress seal elements 166, 168, 170 due to the downward force applied on upper piston 142. If desired, the wellbore or annulus pressure surrounding packer assembly 100 may then be increased to an actuation pressure sufficient burst rupture disks 210 which will operate lower piston assembly 186 as described above to shift packer assembly 100 to the positioned described above with reference to FIGS. 3A-3D.

Referring collectively to FIGS. 2A-2D and 5A-5D, an operating mode of packer assembly 100 will now be described. Packer assembly 100 is shown before and after activation and expansion of expandable seal elements 166, 168, 170 and slip elements 154, 180, respectively, in FIGS. 2A-2D and 5A-5D. Packer assembly 100 may be run into a wellbore on a work string or similar tubular string to a desired depth and then set against a casing string, a liner string or other wellbore surface including an open hole surface. It is noted that during run in, upper activation assembly 128 prevents downward shifting of upper piston 142 by preventing fluid pressure from entering upper activation chamber 132 due to the presence of rupture disks 136 in fluid passageways 134. In addition, upper piston 142 is initially coupled to upper activation assembly 128 by shear screws 148. Further, due to the exposed upper and lower piston areas of upper piston 142, wellbore pressure tends to bias upper piston 142 in a direction away from seal assembly 164. Likewise, lower activation assembly 110 prevents upward shifting of lower piston 192 by preventing fluid pressure from entering lower activation chamber 206 due to the presence of rupture disks 210 in fluid passageways 208. In addition, lower piston 192 is initially coupled to lower assembly 110 by shear screws 216. Further, due to the exposed upper and lower piston areas of lower piston 192, wellbore pressure tends to bias lower piston 192 in a direction away from seal assembly 164.

Setting a accomplished by increasing the wellbore or annulus pressure surrounding packer assembly 100 to an actuation pressure sufficient burst rupture disks 210. For example, when rupture disks 210 burst, fluid pressure from the wellbore enters activation chamber 206 via fluid passageway 208. The forced generated by the fluid pressure acting on a lower surface of lower piston 192 breaks the shear screws 216 allowing lower piston 192 to move upwardly against any opposing force generated by pressure within atmospheric chamber 220, which is preferably negligible. Lower piston 192 then contacts lower intermediate piston section 190 breaking shear screws 202. Lower piston assembly 186 now moves as a single unit in the upward direction toward seal assembly 164. In this configuration, the entire lower surface of lower piston 192 is now exposed to wellbore pressure which generates an upward force on lower piston 192 and drives lower piston assembly 186 in the upward direction.

Figure 5A:
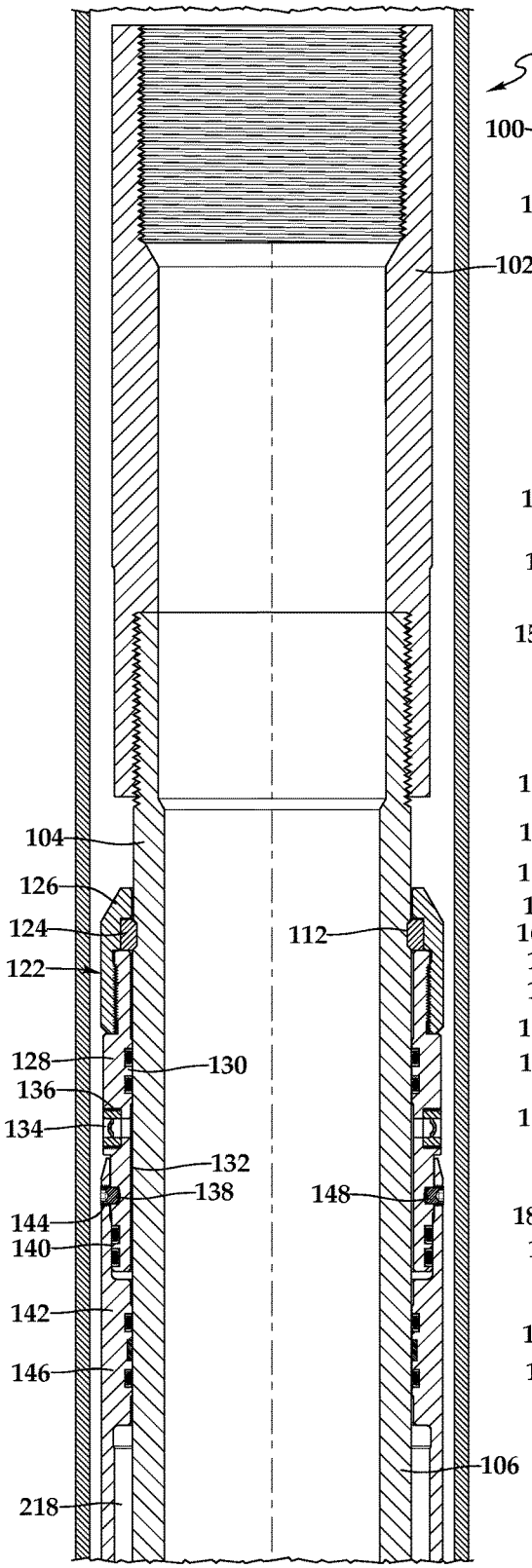
FIGS. 5A-5D are cross-sectional views of consecutive axial sections of a packer assembly having dual hydrostatic pistons for redundant interventionless setting in accordance with an embodiment of the present invention in a set configuration.
Figure 5B:
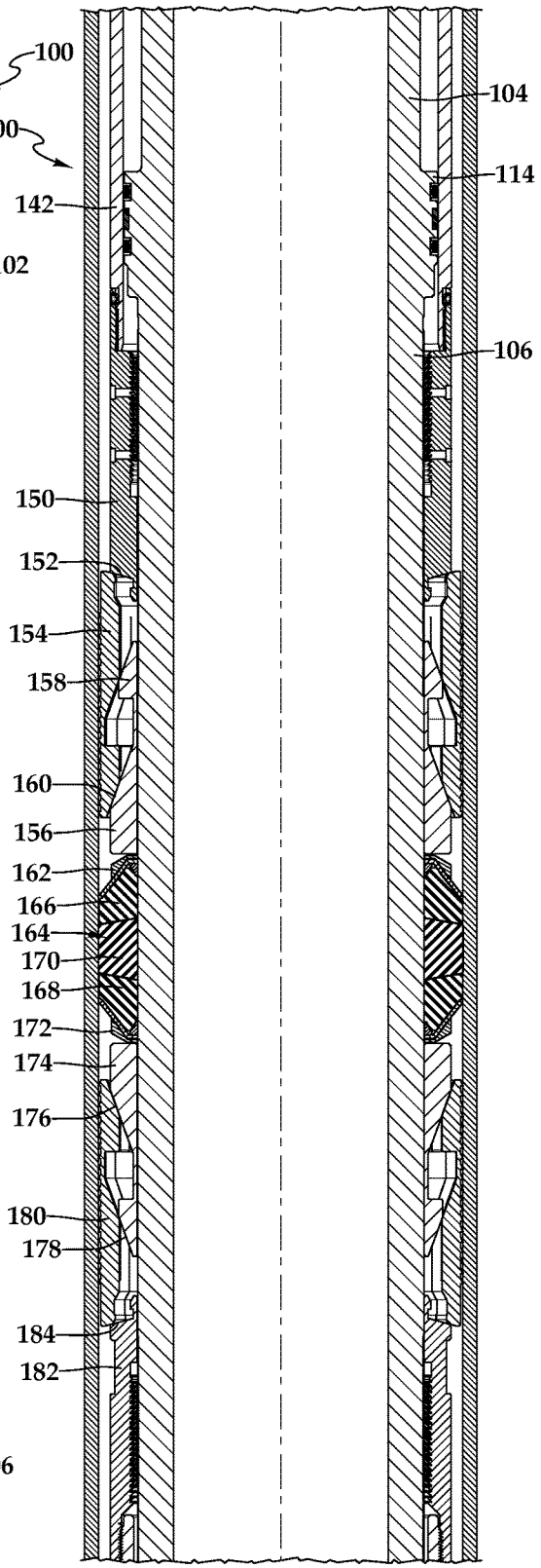
Figure 5C:
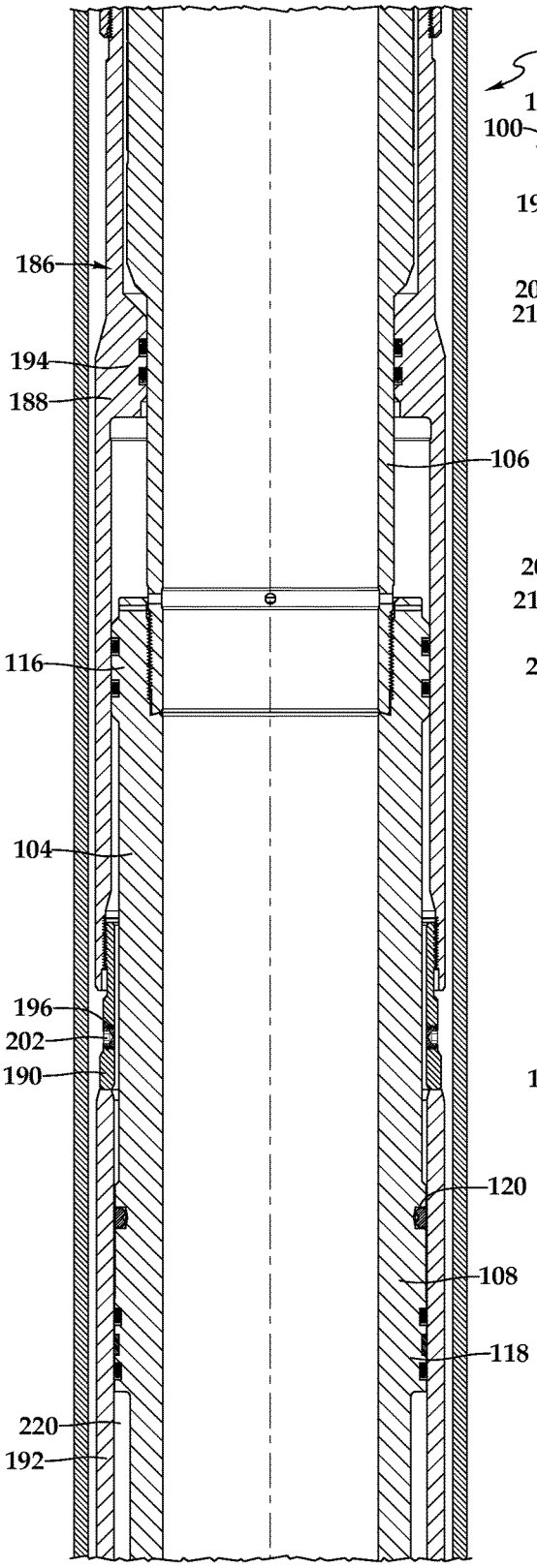
Figure 5D:
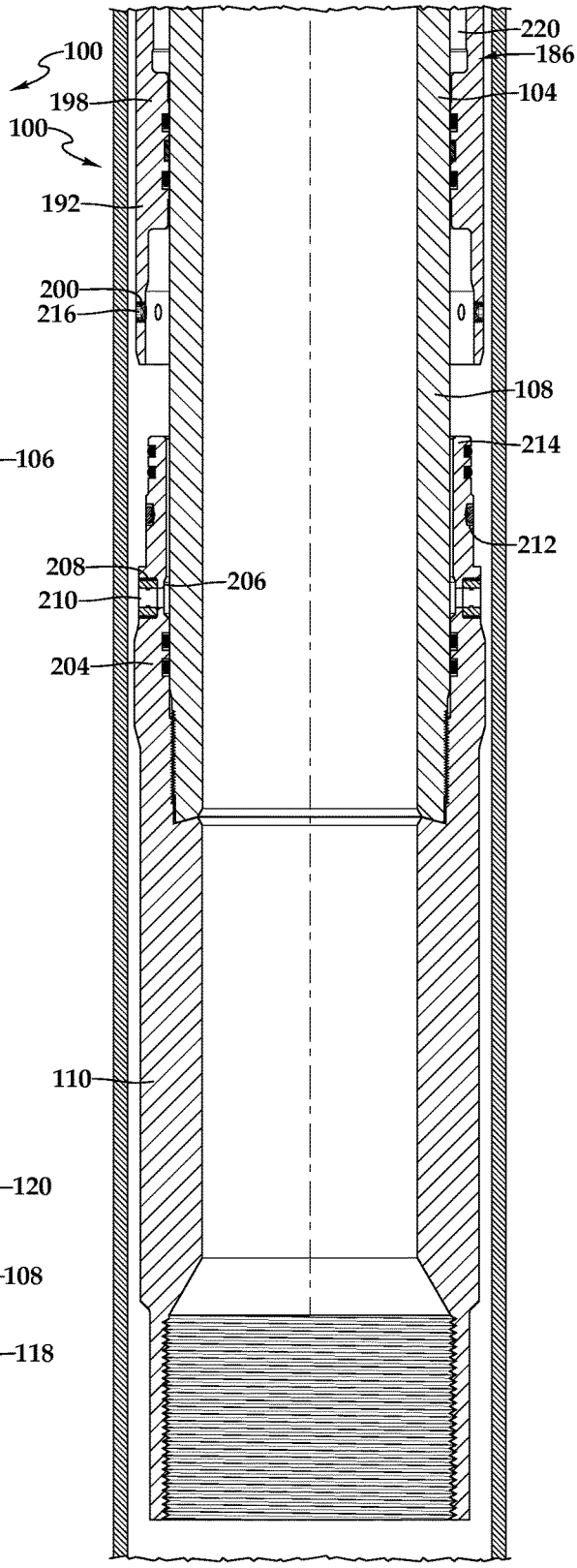

The upwardly moving lower piston assembly 186 acts upon wedge 182 to move wedge 182 upward towards slip element 180. As wedge 182 contacts slip element 180, slip element 180 moves upwardly over wedge 174, which starts to set slip element 180 against the setting surface. As slip element 180 is extending outwardly, it also moves upward causing an upward force on wedge 174 allowing wedge 174 to apply an upward force on lower element backup shoe 172, which begins to move upward relative to packer mandrel 104. The upward movement of lower element backup shoe 172 shifts seal assembly 164 upwardly causing upper element backup shoe 162 to act upwardly on wedge 156. Wedge 156 moves up against and under slip element 154, which starts to set slip element 154 against the setting surface. As slip element 154 is extending outwardly, it also moves upward causing an upward force on wedge 150. Upward movement of wedge 150 is disallowed by upper piston 142 which contacts upper activation assembly 128, as best seen in FIG. 5A.

The compressive force between upper piston 142 and lower piston extension 188 causes radial expansion of seal elements 166, 168, 170 and causes upper element backup shoe 162 and lower element backup shoe 172 to flare outward toward the sealing surface to provide a metal-to-metal seal against a casing or liner string. In this manner, operation of only the lower piston of the dual hydrostatic pistons of packer assembly 100 creates a sealing relationship between seal elements 166, 168, 170 and the setting surface as well as a gripping relationship between slip elements 154, 180 and the setting surface such that packer assembly 100 is fully set. In this configuration, wellbore pressure below packer assembly 100 tends to further secure slip element 180 and compress seal elements 166, 168, 170 due to the upward force applied on lower piston 192. If desired, the wellbore or annulus pressure surrounding packer assembly 100 may then be increased to an actuation pressure sufficient burst rupture disks 136 which will operate upper piston 142 as described above to shift packer assembly 100 to the positioned described above with reference to FIGS. 3A-3D.

Referring collectively to FIGS. 2A-2D and 6A-6D, an operating mode of packer assembly 100 will now be described. Packer assembly 100 is shown before and after activation and expansion of expandable seal elements 166, 168, 170 and slip elements 154, 180, respectively, in FIGS. 2A-2D and 6A-6D. Packer assembly 100 may be run into a wellbore on a work string or similar tubular string to a desired depth and then set against a casing string, a liner string or other wellbore surface including an open hole surface. If, for example, it is not desirable or possible to pressure up the wellbore annulus to burst either of the sets of rupture disks 136, 210, packer assembly 100 of the present invention may nonetheless be set. Packer mandrel 104 includes a contingency access location as indicated at 224 in FIG. 6C. As illustrated, packer mandrel 104 includes a plurality of fluid passageways 226 that may be initially plugged or may be created by a punch-to-set tool operable to punch one or more holes through the wall of packer mandrel 104 at contingency access location 224 if desired. Fluid passageways 226 provide fluid communication between the interior of packer assembly 100 and a contingency chamber 228.

Figure 6A:
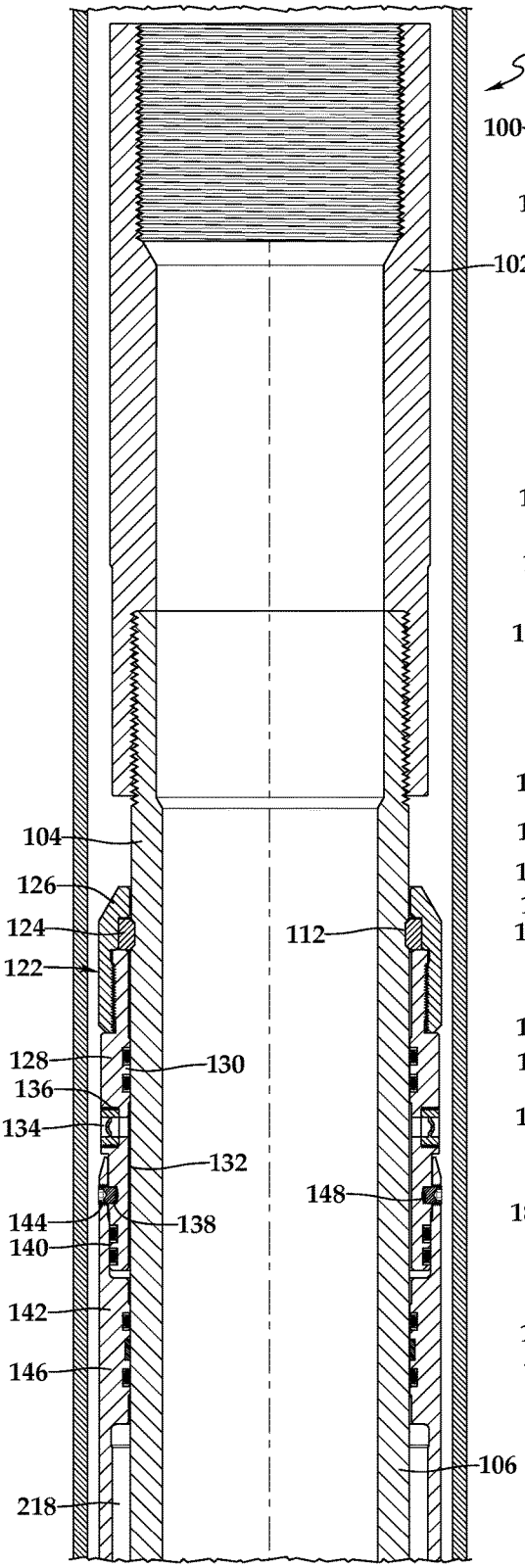
FIGS. 6A-6D are cross-sectional views of consecutive axial sections of a packer assembly having dual hydrostatic pistons for redundant interventionless setting in accordance with an embodiment of the present invention in a set configuration.
Figure 6B:
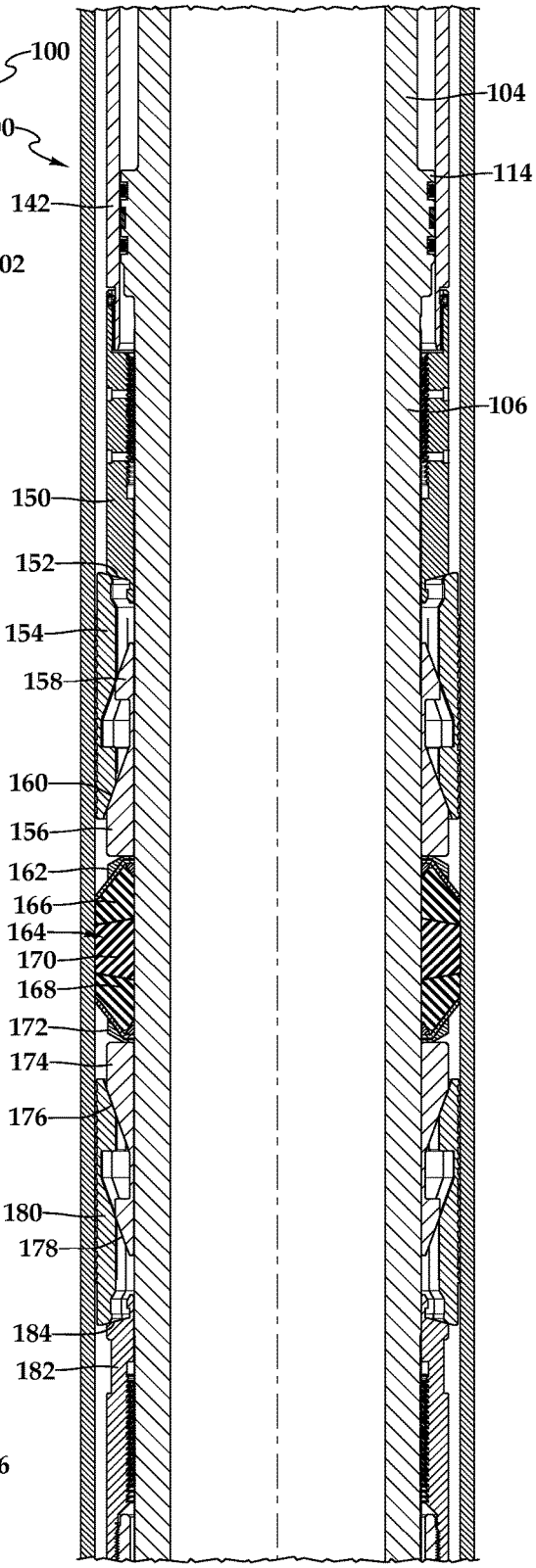
Figure 6C:
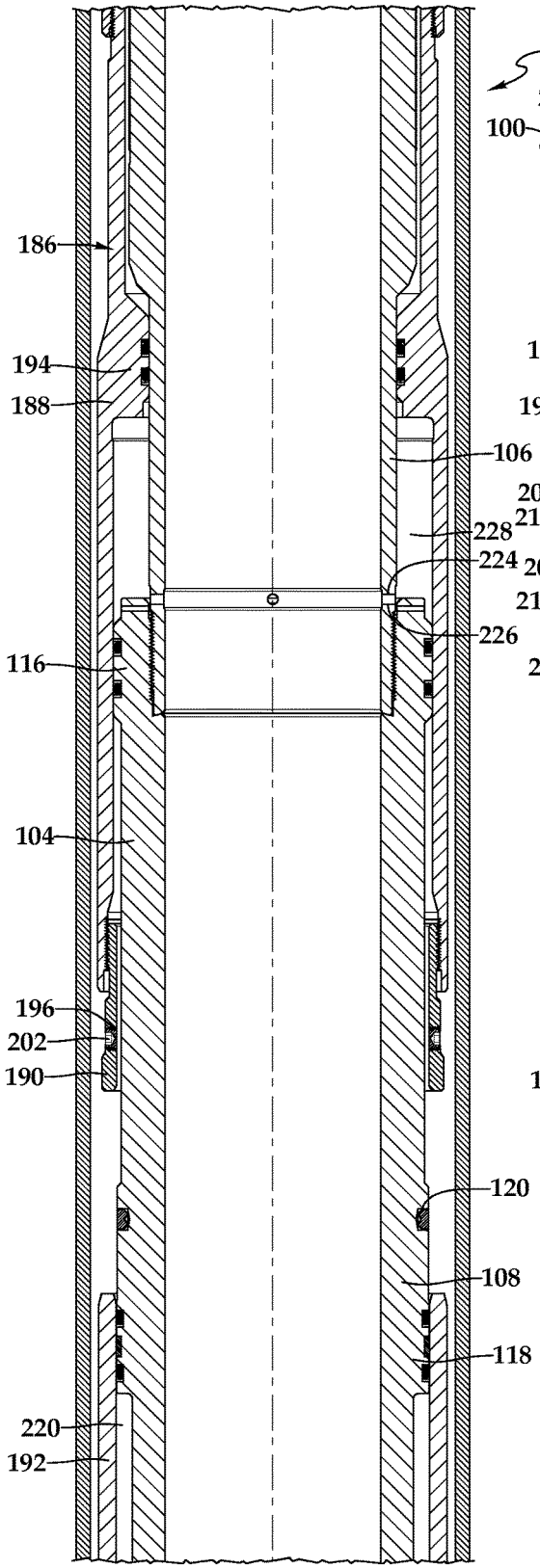
Figure 6D:
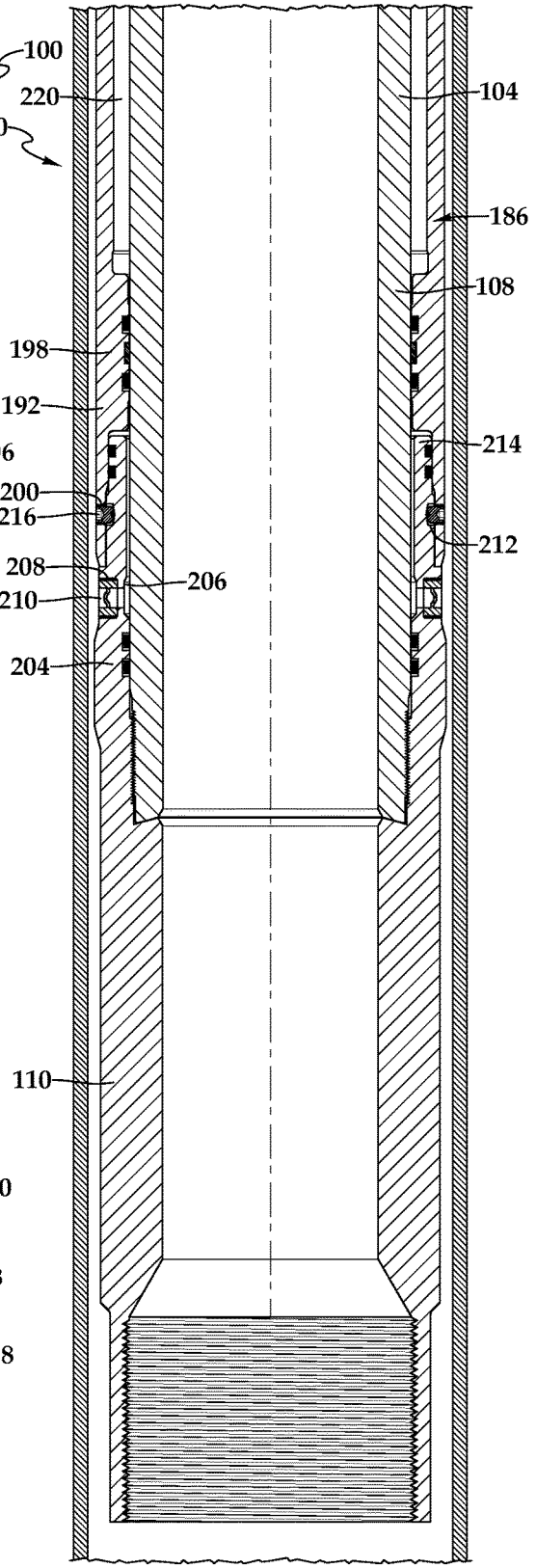

Setting a accomplished by increasing the tubing pressure within packer assembly 100 which is communicated to contingency chamber 228 and acts on a lower surface of lower piston extension 188. The upward force on lower piston extension 188 also acts on lower intermediate piston section 190 breaking shear screws 202 enabling upward movement of lower piston extension 188. This upward movement act upon wedge 182 to move wedge 182 upward towards slip element 180. As wedge 182 contacts slip element 180, slip element 180 moves upwardly over wedge 174, which starts to set slip element 180 against the setting surface. As slip element 180 is extending outwardly, it also moves upward causing an upward force on wedge 174 allowing wedge 174 to apply an upward force on lower element backup shoe 172, which begins to move upward relative to packer mandrel 104. The upward movement of lower element backup shoe 172 shifts seal assembly 164 upwardly causing upper element backup shoe 162 to act upwardly on wedge 156. Wedge 156 move up against and under slip element 154, which starts to set slip element 154 against the setting surface. As slip element 154 is extending outwardly, it also moves upward causing an upward force on wedge 150. Upward movement of wedge 150 is disallowed by upper piston 142 which contacts upper activation assembly 128, as best seen in FIG. 6A.

The compressive force between upper piston 142 and lower piston extension 188 causes radial expansion of seal elements 166, 168, 170 and causes upper element backup shoe 162 and lower element backup shoe 172 to flare outward toward the sealing surface to provide a metal-to-metal seal against a casing or liner string. In this manner, packer assembly 100 creates a sealing relationship between seal elements 166, 168, 170 and the setting surface as well as a gripping relationship between slip elements 154, 180 and the setting surface.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A packer assembly for use in a wellbore comprising:

a packer mandrel;

a first piston slidably disposed about the packer mandrel defining a first chamber therewith;

a first activation assembly disposed about the packer mandrel initially preventing movement of the first piston;

a piston assembly including an intermediate piston section spaced away from a second piston, the piston assembly being slidably disposed about the packer mandrel and the second piston defining a second chamber therewith;

a second activation assembly disposed about the packer mandrel initially preventing movement of the second piston; and a seal assembly disposed about the packer mandrel and positioned between the first and second pistons;

wherein, actuation of the first activation assembly allows a force generated by a pressure difference between the wellbore and the first chamber to shift the first piston in a first direction toward the seal assembly to radially expand the seal assembly; and wherein, actuation of the second activation assembly allows a force generated by a pressure difference between the wellbore and the second chamber to shift the second piston in a second direction toward the seal assembly to radially expand the seal assembly.

2. The packer assembly as recited in claim 1 further comprising a slip assembly disposed about the packer mandrel and positioned between the first and second pistons.

3. The packer assembly as recited in claim 2 wherein the slip assembly further comprises first and second slip elements, the first slip element positioned between the seal assembly and the first piston, the second slip element positioned between the seal assembly and the second piston.

4. The packer assembly as recited in claim 1 wherein the first activation assembly further comprises:

a first housing section at least partially disposed about the packer mandrel defining a first activation chamber with the packer mandrel and the first piston; and a first pressure actuated element positioned in a first fluid flow path between the wellbore and the first activation chamber initially preventing fluid flow therethrough until wellbore pressure exceeds a first predetermined actuation pressure.

5. The packer assembly as recited in claim 4 further comprising a first frangible member initially coupling the first piston to the first housing section.

6. The packer assembly as recited in claim 4 wherein the second activation assembly further comprises:

a second housing section at least partially disposed about the packer mandrel defining a second activation chamber with the packer mandrel and the second piston; and a second pressure actuated element positioned in a second fluid flow path between the wellbore and the second activation chamber initially preventing fluid flow therethrough until wellbore pressure exceeds a second predetermined actuation pressure.

7. The packer assembly as recited in claim 6 further comprising a second frangible member initially coupling the second piston to the second housing section.

8. The packer assembly as recited in claim 6 wherein the first and second predetermined actuation pressures are substantially the same.

9. The packer assembly as recited in claim 6 wherein the first and second predetermined actuation pressures are different.

10. The packer assembly as recited in claim 1 wherein the first piston defines a contingency chamber with the packer mandrel and wherein increasing pressure in the contingency chamber shifts the first piston in the first direction toward the seal assembly to radially expand the seal assembly.

11. A method for setting a packer assembly in a wellbore, the method comprising:

providing a packer assembly having a packer mandrel with a seal assembly disposed thereabout;

running the packer assembly into the wellbore;

preventing movement of a first piston toward the seal assembly with a first activation assembly disposed about the packer mandrel;

preventing movement of a second piston toward the seal assembly with a second activation assembly disposed about the packer mandrel;

actuating the first activation assembly to allow a force generated by a pressure difference between the wellbore and a first chamber defined between the first piston and the packer mandrel to shift the first piston in a first direction toward the seal assembly to radially expand the seal assembly; and actuating the second activation assembly to allow a force generated by a pressure difference between the wellbore and a second chamber defined between the second piston and the packer mandrel to shift the second piston in a second direction toward an intermediate piston section spaced away from the second piston and toward the seal assembly to radially expand the seal assembly.

12. The method as recited in claim 11 wherein actuating the first and second activation assemblies further comprises radially expanding a slip assembly disposed about the packer mandrel and positioned between the first and second pistons.

13. The method as recited in claim 11 wherein actuating the first activation assembly further comprises breaking a first frangible member coupling the first piston to a first housing section.

14. The method as recited in claim 11 wherein actuating the first activation assembly further comprises bursting a first pressure actuated element responsive to an increase in wellbore pressure to a first predetermined actuation pressure.

15. The method as recited in claim 11 wherein actuating the first activation assembly further comprises pressurizing a first activation chamber disposed between a first housing section, the packer mandrel and the first piston.

16. The method as recited in claim 11 wherein actuating the first activation assembly further comprises exposing a first piston area of the first piston to wellbore pressure.

17. The method as recited in claim 11 wherein actuating the second activation assembly further comprises breaking a second frangible member coupling the second piston to a second housing section.

18. The method as recited in claim 11 wherein actuating the second activation assembly further comprises bursting a second pressure actuated element responsive to an increase in wellbore pressure to a second predetermined actuation pressure.

19. The method as recited in claim 11 wherein actuating the second activation assembly further comprises pressurizing a second activation chamber disposed between a second housing section, the packer mandrel and the second piston.

20. The method as recited in claim 11 wherein actuating the second activation assembly further comprises exposing a second piston area of the second piston to wellbore pressure.

21. A method for setting a packer assembly in a wellbore, the method comprising:

providing a packer assembly having a packer mandrel with a seal assembly disposed thereabout;

running the packer assembly into the wellbore;

preventing movement of a first piston toward the seal assembly with a first activation assembly disposed about the packer mandrel;

preventing movement of a second piston toward the seal assembly with a second activation assembly disposed about the packer mandrel;

increasing wellbore pressure to a first predetermined actuation pressure;

actuating the first activation assembly to allow a force generated by a pressure difference between the wellbore and a first chamber defined between the first piston and the packer mandrel to shift the first piston in a first direction toward the seal assembly to radially expand the seal assembly;

increasing wellbore pressure to a second predetermined actuation pressure; and actuating the second activation assembly to allow a force generated by a pressure difference between the wellbore and a second chamber defined between the second piston and the packer mandrel to shift the second piston in a second direction toward an intermediate piston section spaced away from the second piston and toward the seal assembly to radially expand the seal assembly.

22. The method as recited in claim 21 wherein increasing wellbore pressure to a first predetermined actuation pressure further comprises bursting a first pressure actuated element and pressurizing a first activation chamber disposed between a first housing section, the packer mandrel and the first piston.

23. The method as recited in claim 22 wherein actuating the first activation assembly further comprises exposing a first piston area of the first piston to wellbore pressure.

24. The method as recited in claim 22 wherein increasing wellbore pressure to a second predetermined actuation pressure further comprises bursting a second pressure actuated element and pressurizing a second activation chamber disposed between a second housing section, the packer mandrel and the second piston.

25. The method as recited in claim 24 wherein actuating the second activation assembly further comprises exposing a second piston area of the second piston to wellbore pressure.

* * * * *